US006699038B2

(12) United States Patent
Stewart

(10) Patent No.: US 6,699,038 B2
(45) **Date of Patent: *Mar. 2, 2004**

(54) TOOTHBRUSHES

(75) Inventor: Timothy Nathaniel Stewart, Sanford, FL (US)

(73) Assignee: Seagreen Holding Company Limited, Grand Cayman (KY)

( * ) Notice: Subject to any disclaimer, the term of this patent is extended or adjusted under 35 U.S.C. 154(b) by 0 days.

This patent is subject to a terminal disclaimer.

(21) Appl. No.: 09/955,873

(22) Filed: Sep. 19, 2001

(65) Prior Publication Data

US 2003/0208145 A1 Nov. 6, 2003

Related U.S. Application Data

(63) Continuation-in-part of application No. 09/509,370, filed as application No. PCT/GB98/02811 on Sep. 16, 1998, now Pat. No. 6,315,556.

(60) Provisional application No. 60/268,260, filed on Feb. 13, 2001.

(51) Int. Cl.[7] ..... A61G 17/02

(52) U.S. Cl. ..... 433/80; 433/91; 601/162

(58) Field of Search ..... 433/80, 91; 15/322, 15/167.1; 132/308, 311; 601/162; D4/107, 108, 113, 114, 115

(56) References Cited

U.S. PATENT DOCUMENTS

| | | | | | |
|---|---|---|---|---|---|
| 1,012,613 | A | | 12/1911 | De Witt | |
| 1,211,468 | A | * | 1/1917 | Mclean | 132/311 |
| 1,364,188 | A | * | 1/1921 | Draenert | 132/311 |
| 1,768,301 | A | * | 6/1930 | Webber | 15/167.1 |
| 2,150,842 | A | | 3/1939 | Oliver | |
| 2,303,667 | A | * | 12/1942 | Taborski | 15/167.1 |
| 3,101,545 | A | | 8/1963 | Baughan | |
| 3,864,047 | A | * | 2/1975 | Sherrod | 132/309 |
| 4,580,588 | A | * | 4/1986 | Swope, Jr. | 132/309 |
| 4,589,159 | A | * | 5/1986 | Streibel | 15/167.1 |
| 4,672,953 | A | | 6/1987 | DiVito | |
| 4,963,046 | A | * | 10/1990 | Eguchi | 433/80 |
| 5,062,413 | A | | 11/1991 | Bullard | |
| 5,458,563 | A | | 10/1995 | Stewart | |
| 5,463,792 | A | | 11/1995 | Hogan et al. | |
| 5,484,281 | A | | 1/1996 | Renow et al. | |
| 5,573,398 | A | | 11/1996 | Towle et al. | |
| 6,238,213 | B1 | * | 5/2001 | Young et al. | 433/91 |

* cited by examiner

*Primary Examiner*—Todd E. Manahan
(74) *Attorney, Agent, or Firm*—Trexler, Bushnell, Giangiorgi, Blackstone & Marr, Ltd.

(57) ABSTRACT

A toothbrush which includes a handle with a head portion at one end, a recess in the head, a bristle pack located in the recess with the bristles attached by one end to the base of the recess, the recess opening being bounded by inwardly directed shoulders, and the outer extremities of the bristles lying in abutting relationship with the inner faces of the shoulders. There is a fluid supply line provided along or through the handle and communicating with the recess. Preferably, the bristle pack is formed by a number of clusters of bristles, it being the outermost clusters that are in close abutting relationship with the edges of the shoulders of the recess, and adjacent clusters at least at the edges of the pack being in close but spaced relationship.

28 Claims, 6 Drawing Sheets

TOOTHBRUSHES

RELATED APPLICATION

This application is a continuation-in-part of U.S. patent application Ser. No. 09/509.370, filed Mar. 24, 2000, now U.S. Pat. No. 6,315,556 which was a national stage filing under 35 U.S.C. §371 of PCT/GB98/02811, filed Sep. 16, 1998, which International Application was published by the International Bureau in English on Apr. 1, 1999, and claimed the benefit of British patent application Serial No. 9720313.7, filed Sep. 25, 1997. The present application also claims tile benefit of United States provisional application Serial No. 60/268.260, filed Feb. 13, 2001.

BACKGROUND

This invention relates to toothbrushes and in particular toothbrushes for use in oral hygiene systems suited for use by bedridden users.

Conventionally, water is applied to the bristled head of a toothbrush to assist the cleaning action of a dentifrice applied to its bristles, and following brushing, it is usual to rinse the mouth. To the able bodied or to those able to sit upright without undue difficulty, cleaning the teeth is not particularly troublesome.

However, when it is the case of a bedridden patient, not able to sit upright, or only able to sit upright with considerable difficulty and discomfort, cleaning the teeth is particularly troublesome, and especially rinsing the mouth, as neither the application of fluid to assist the action of the dentifrice nor subsequent rinsing of the mouth can be effected in conventional manner with the patient in the prone position.

It is known from such as U.S. Pat. No. 4,672,953 to provide a toothbrush with first and second passageway means through the handle for the supply of fluid to the bristles of the brush and its removal from the patient's mouth by suction, in an attempt to overcome the difficulties mentioned above in relation to patients who must, of necessity, remain in a prone position.

However, such a construction still leaves room for improvement in the sense that with prone patients it can frequently occur that the patient's mouth inadvertently closes on to the toothbrush during use causing an undesired build-up of vacuum during removal of spent fluid. This problem is attended to in European Patent Number 0557337B where a toothbrush construction is provided that ensures that in the circumstance when a patient's mouth does inadvertently close on to the toothbrush there is the substantial guarantee that a vacuum buildup in the mouth is prevented.

OBJECT AND SUMMARY

The object of the present invention is to provide a toothbrush construction of simpler and less expensive construction but with the same time a significantly improved ability to provide and remove fluid and prevent a vacuum build-up.

According to the present invention, a toothbrush comprises a handle with a head portion at one end, a recess in the head, a bristle pack located in the recess with the bristles attached by one end to the base of the recess, the recess opening being bounded by inwardly directed shoulders, and the outer extremities of the bristles lying in abutting relationship with the inner faces of the shoulders, and there being a fluid supply line provided along or through the handle and communicating with the recess. Preferably, the bristle pack is formed by a number of clusters of bristles, it being the outermost clusters that are in close abutting relationship with the edges of the shoulders of the recess, and adjacent clusters at least at the edges of the pack being in close but spaced relationship.

Thus, and in use, water or cleansing agent cam be supplied to the bristle pack to emerge from the bristle pack during teeth cleaning, and simultaneously, the connection of the vacuum line to a source of reduced pressure or a vacuum pump causes the extraction of water or cleansing fluid from the mouth.

Most desirably, the bristle pack is dimensioned such that it locates in the recess in the bristle head with clearance on all four sides, the outer bristles or bristle clusters extending vertically from the base of the recess in alignment with the edges of the flanges at the edges of the recess to ensure that vacuum is provided around the whole of the bristle pack.

By having the bristles or bristle clusters at the edge of the bristle pack in abutting engagement with the faces of the shoulders at the edges of the recess, there is a major concentration of vacuum created around the base of the bristles between adjacent bristles or bristle clusters not only at the edges of the bristle pack, but also over the whole of its area, maximizing the extraction of fluid from the mouth of the user.

Able bodied users can deal adequately with fluid in the mouth should it be that removal of fluid is not at the same rate as the supply of water or cleansing fluid. However, with users who must remain prone, are ill or semi-conscious, it is essential that control of water or cleansing fluid supply to the mouth is balanced with the rate of extraction, to ensure that the mouth of the user does not fill with fluid.

Equally, it is important that if such users close their mouth around the toothbrush, an excess vacuum does not build up in the mouth. It is therefore desirable that there is an air vent means located on the handle and extending along the handle form a position in close proximity to the bristles, the air vent means having an inlet to longitudinal spaced relationship along the length of the handle to prevent the inlet being closed by the lips of the user.

The vent may be a tube-like member located on the handle, but preferably the vent is formed by at least one and preferably two diametrically opposed passageways within the confines of the handle, with longitudinally spaced access holes through the outer wall of the passageway.

To enable the toothbrush of the invention to be used in conjunction with a machine such as is disclosed in European Patent Number 0557337B, the end of the handle remote form the bristle head may be fashioned as a plug-like connector, the machine being provided with a mating plug-like connector such that the first chamber can be connected to a source of vacuum, i.e., to a fluid pump on the machine, by one simple act. It enables a brush to be dedicated to a particular use in the circumstances where it is the machine of European Patent Number 0557337B, and in use as in such as a hospital.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DESCRIPTION

Figure 1:
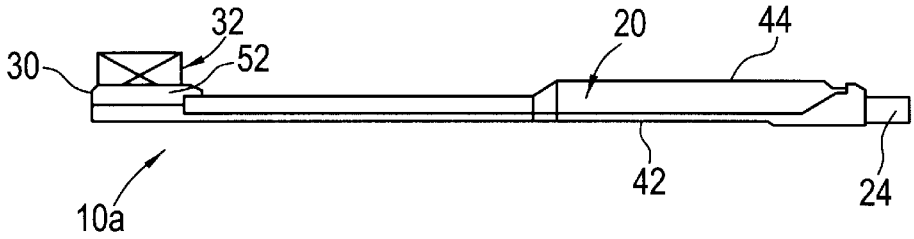
FIG. 1 is a side elevational view of a toothbrush which is in accordance with an embodiment of the present invention.

While the invention may be susceptible to embodiment in different forms, there are shown in the drawings, and herein will be described in detail, specific embodiments with the understanding that the present disclosure is to be considered an exemplification of the principles of the invention, and is not intended to limit the invention to that as illustrated and described herein.

Figure 2:
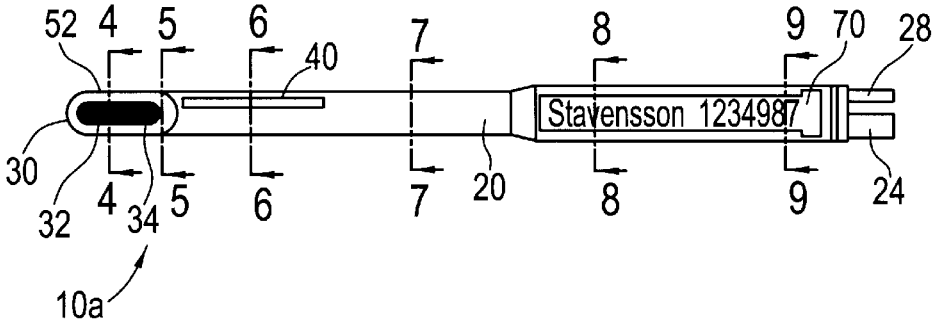
FIG. 2 is a top plan view of the toothbrush shown in FIG. 1.
Figure 11:
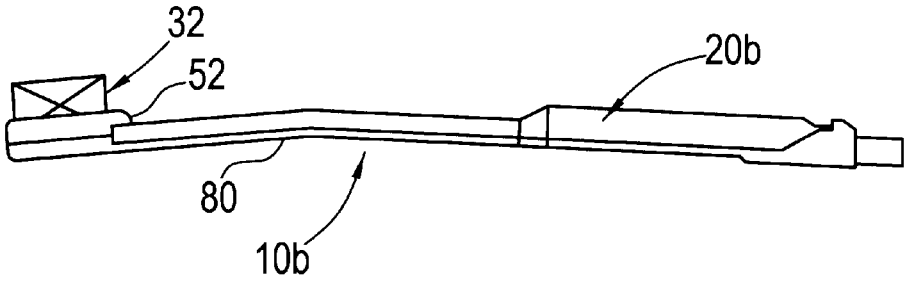
FIG. 11 is a side elevational view of a toothbrush which is similar to that which is shown in FIG. 1, but where the toothbrush has a bend.
Figure 12:
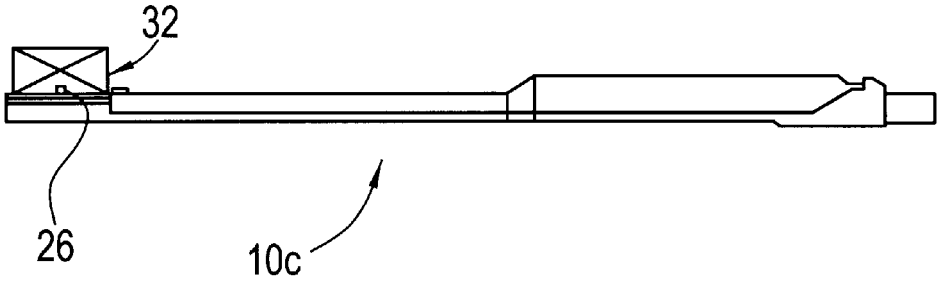
FIG. 12 is a side elevational view of a toothbrush which is in accordance with another embodiment of the present invention.
Figure 13:
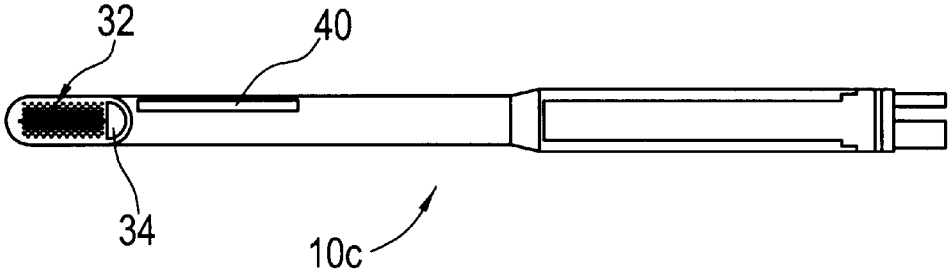
FIG. 13 is a top plan view of the toothbrush shown in FIG. 12.
Figure 16:
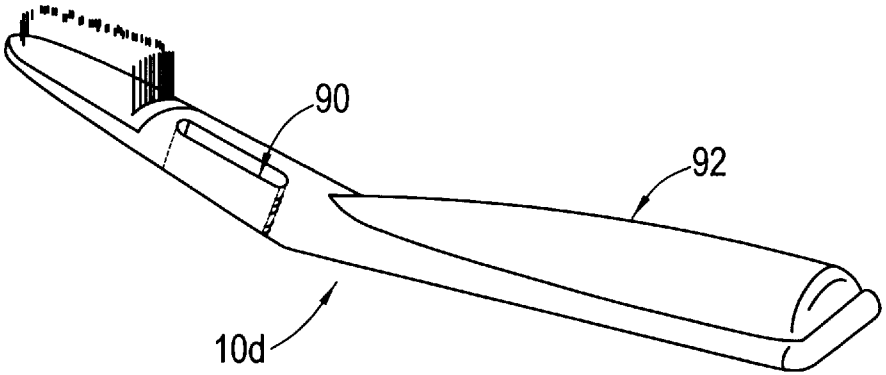
FIG. 16 is a perspective view of a toothbrush which is in accordance with yet another embodiment of the present invention.
Figure 17:
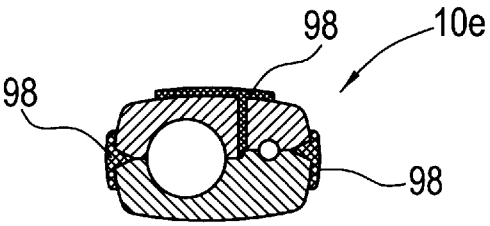
FIG. 17 is a cross sectional view of a toothbrush which is in accordance with still yet another embodiment of the present invention.
Figure 18:
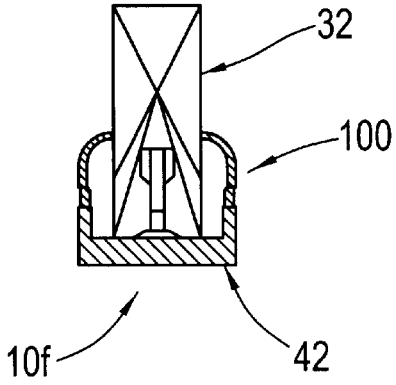
FIG. 18 is a cross-sectional view of the head of a toothbrush which in accordance with still yet another embodiment of the present invention, wherein bristles are attached directly to a base.
Figure 19:
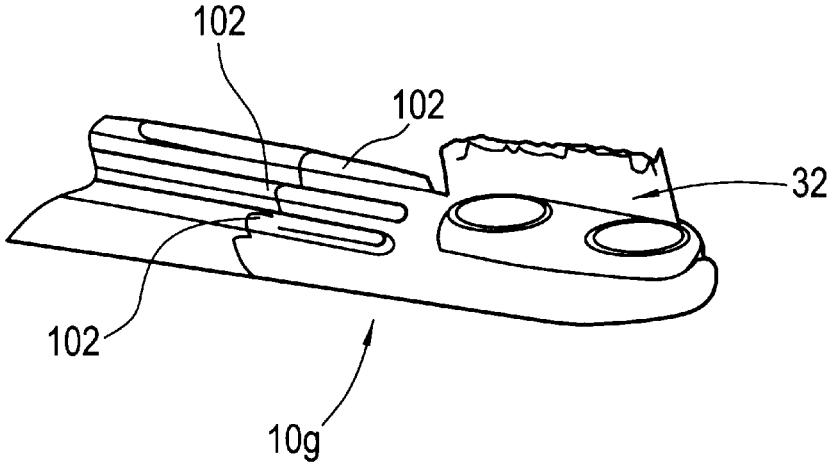
FIG. 19 is a perspective view of an end of a toothbrush which is in accordance with still yet another embodiment of the present invention, wherein there are a plurality of ribs on the surface of the toothbrush to prevent a build up of vacuum.

Shown in the drawings are several toothbrushes which are in accordance with various embodiments of the present invention. Specifically, FIGS. 1 and 2 show a toothbrush 10*a* which is in accordance with a first embodiment of the present invention, FIG. 11 shows a toothbrush 10*b* which is in accordance with a second embodiment of the present invention, FIGS. 12 and 13 show a toothbrush 10*c* which is in accordance with a third embodiment of the present invention, FIG. 16 shows a toothbrush 10*d* which is in accordance with a fourth embodiment of the present invention, FIG. 17 shows the cross-sectional profile of a toothbrush 10*e* which is in accordance with a fifth embodiment of the present invention, FIG. 18 is a cross-sectional view of the head of a toothbrush 10*f* which in accordance with a sixth embodiment of the present invention, and FIG. 19 is a perspective view of an end of a toothbrush 10*g* which is in accordance with a seventh embodiment of the present invention. Each of the toothbrushes 10*a*–10*g* provide fluid supply, suction for removing the fluid from a user's mouth, and vent means for preventing an excess vacuum from building up in the mouth. Additionally, each of the toothbrushes 10*a*–10*g* have a relatively simple and inexpensive construction.

Figure 3:
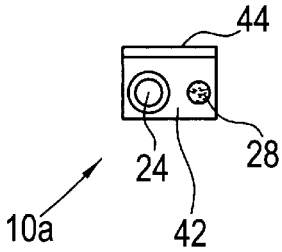
FIG. 3 is an end view of the toothbrush shown in FIGS. 1 and 2.
Figure 4:
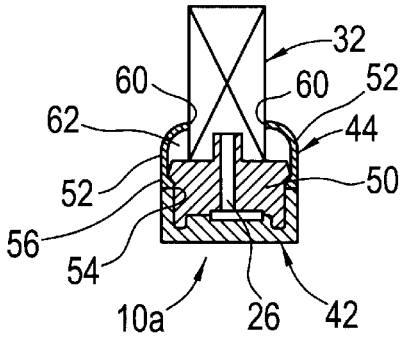
FIG. 4 is a cross-sectional view of the toothbrush shown in FIGS. 1 and 2, taken along line 4—4 of FIG. 2.
Figure 5:
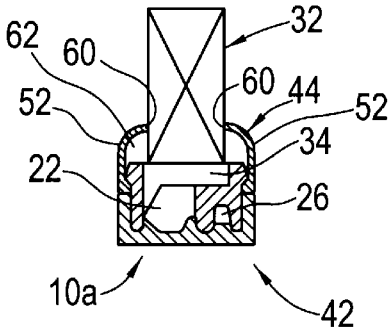
FIG. 5 is a cross-sectional view of the toothbrush shown in FIGS. 1 and 2, taken along line 5—5 of FIG. 2.
Figure 6:
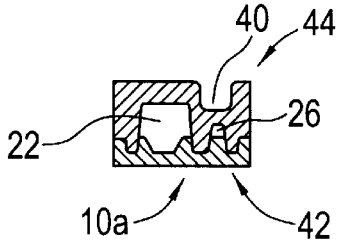
FIG. 6 is a cross-sectional view of the toothbrush shown in FIGS. 1 and 2, taken along line 6—6 of FIG. 2.
Figure 7:
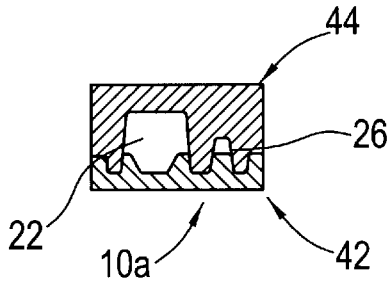
FIG. 7 is a cross-sectional view of the toothbrush shown in FIGS. 1 and 2, taken along line 7—7 of FIG. 2.

The toothbrush 10*a* shown in FIGS. 1 and 2 will first be described in detail, and then the other toothbrushes 10*b*–10*g* will be described with emphasis on the differences. With regard to the toothbrush 10*a* shown in FIGS. 1 and 2, FIG. 3 shows an end view thereof, and FIGS. 4–9 show various cross-sectional views taken along corresponding lines of FIG. 2 (i.e. FIG. 4 is a cross-sectional view along line 4—4 of FIG. 2, FIG. 5 is a cross-sectional view along line 5—5 of FIG. 2, etc.).

The toothbrush 10*a* shown in FIGS. 1 and 2 has a first chamber in the form of a hollow handle 20 to provide a passageway 22 (see FIGS. 5–10) for vacuum, there being a connection 24 to the passageway 22, which allows connection of the passageway 22 to a source of vacuum. Extending through the handle 20 is a fluid supply line 26, there being a connection 28 to the fluid supply line 26, which allows connection of the fluid supply line 26 to an appropriate source of fluid to be delivered to the mouth of a patient.

At the closed end of the handle is a bristle head 30 in which are located packed bristles 32, the supply line 26 for fluid emerging directly in the center of the packed bristles 32. The bristles 32 are surrounded by an area or opening 34 that can be a series of slots or can be a surface through which are provided a series of holes whereby to communicate the area immediately around the bristles 32 with the interior of the bristle head 30 and hence to the vacuum passageway 22.

As shown in FIG. 2, on the surface of the handle 20, to the side from which the bristles 32 emerge, is a longitudinal groove 40. As will be described later herein, the longitudinal groove 40 functions as a vent to prevent build up of vacuum in the mouth of a user if the user closes her or her mouth onto the toothbrush 10*a*.

As shown in FIGS. 4–9, the toothbrush 10*a* includes a lower portion 42 and an upper portion 44 which is attached, such as via welding, an adhesive, etc.) to the lower portion 42. As shown in FIGS. 4–9, the lower portion 42 and upper portion 44 mate to form the passageways 22 and 24 for vacuum and fluid, respectively. FIG. 10 shows the lower portion 42 removed from the upper portion 44. As shown in FIG. 10, the lower portion 42 provides the connections 24 and 28 to vacuum and fluid, respectively. As shown in FIGS. 4 and 5, the upper portion 44 includes a pad 50 through which the fluid line 26 emerges. The bristles 32 are attached directly to the top surface of the pad 50. Alternatively, as shown in FIG. 18, the bristles 32 may be attached directly to a surface of the lower portion 42.

As shown in FIGS. 4 and 5, a rim 52 is fitted to the pad 50. Specifically, a ridge 54 of the rim 52 is fitted under a lip 56 on the pad 50. The rim 52 includes upper interned edges or shoulders 60 which contact the outermost bristles. The rim 52 creates a recess 62 from which the bristles 32 emerge. The contact between the outermost bristles and the upper interned edges 60 of the rim 52 provides for enhanced concentration of vacuum withdrawal of spent fluid and debris through the bristles 32. Additionally, the openings 34 into the vacuum passageway 22 (see FIG. 5) is within the area (i.e. recess 62) defined by the rim 52.

Figure 8:
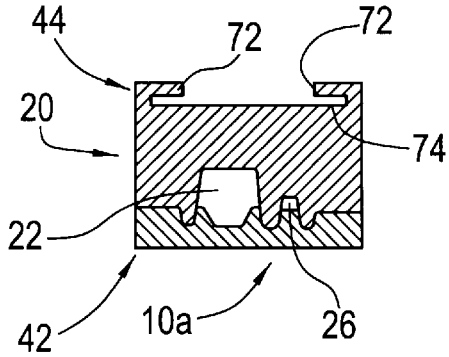
FIG. 8 is a cross-sectional view of the toothbrush shown in FIGS. 1 and 2, taken along line 8—8 of FIG. 2.
Figure 9:
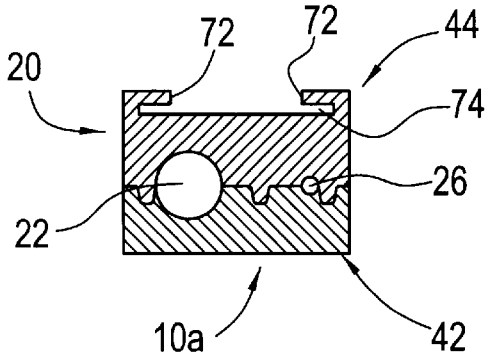
FIG. 9 is a cross-sectional view of the toothbrush shown in FIGS. 1 and 2, taken along line 9—9 of FIG. 2.
Figure 10:
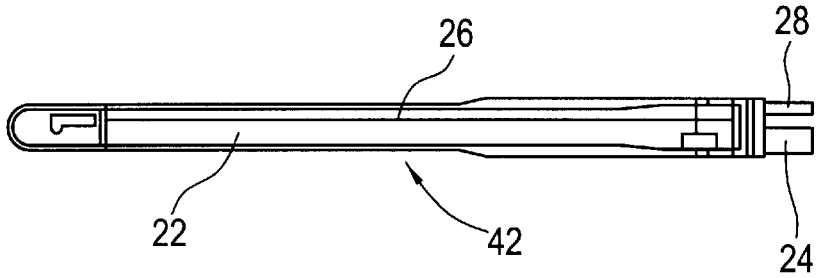
FIG. 10 is a top plan view of a bottom portion of the toothbrush shown in FIG. 1.

As shown in FIGS. 2, 8 and 9, the toothbrush 10*a*, and specifically the upper portion 44 thereof, provides structure for receiving a placard 70 for identifying, for example, a patient. The structure may include inwardly extending flanges 72 which define a channel 74 for receiving the placard 70 (the placard 70 is not shown in FIGS. 8 and 9, but is shown in FIG. 2).

In use, and with connection 24 attached to a source of vacuum and connection 26 attached to a source of fluid, the toothbrush 10*a* can be placed within the mouth of a patient to brush the patients, teeth, the simultaneous application of an appropriate fluid and its removal is to the considerable advantage of particularly a prone or comatose patient in allowing a proper cleansing of the teeth without the patient chocking or there being spillage of fluid from the patient's mouth. In a circumstance where the patient's mouth inadvertently closes onto the toothbrush 10*a*, the length of groove 40 is such that the patient's mouth cannot close beyond its end, and consequently at least a portion of the groove 40 remains exposed to allow air to be drawn into the patient's mouth and hence prevent vacuum applied through the bristle head 30 to cause an unwanted build up of vacuum in the mouth of the patient.

The toothbrush 10*b* shown in FIG. 11 is very much like the toothbrush 10*a* shown in FIGS. 1 and 2 (and FIGS. 3–10), and includes bristles 32, rim 52 and a handle 20*b*. The toothbrush 10*b* differs from toothbrush 10*a* in that toothbrush 10*b* includes a bend, i.e. handle 20*b* is angled. This provides that the toothbrush 10*b* can be placed on a surface with the head held clear of the surface.

Figure 14:
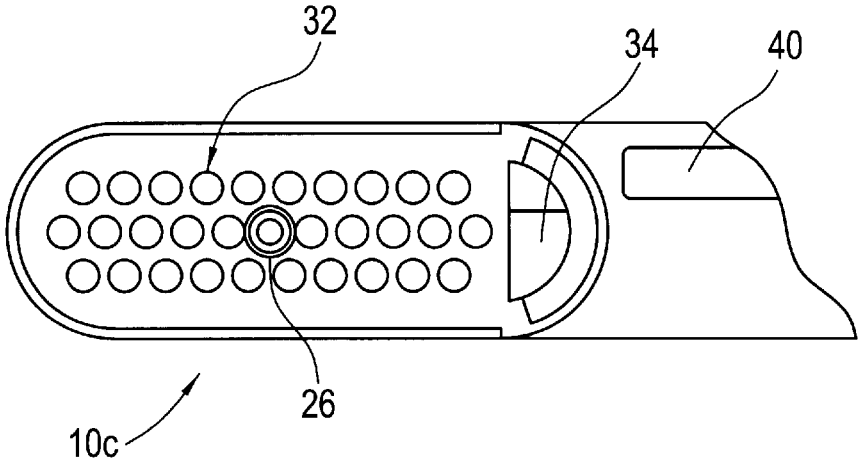
FIG. 14 is an enlarged top plan view of an end of the toothbrush shown in FIGS. 12 and 13.
Figure 15:
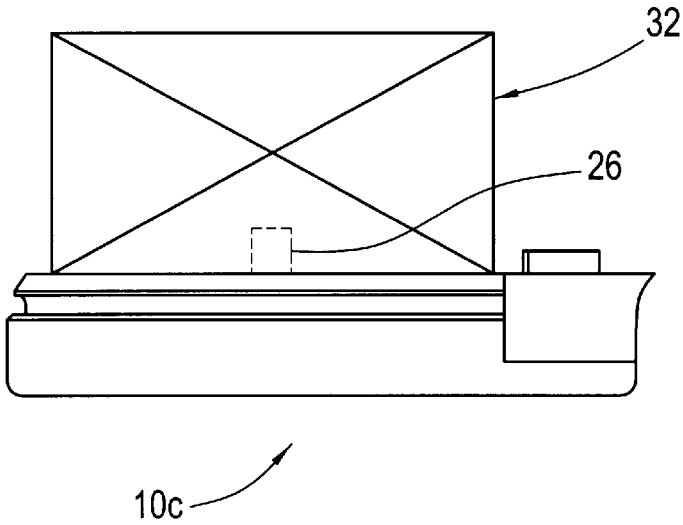
FIG. 15 is an enlarged side elevational view of the end of the toothbrush shown in FIGS. 12 and 13.

The toothbrush 10*c* shown in FIGS. 12 and 13 (see also FIGS. 14 and 15) is very much like the toothbrush 10*a* shown in FIGS. 1 and 2 (and FIGS. 3–10), except the toothbrush 10*c* does not include any rim 52. The toothbrush 10*c* includes a groove 40 and an opening 34 into the vacuum passageway 22, as well as bristles 32 and a fluid supply inlet 26. However, unlike with toothbrush 10*a*, the opening 34, bristles 32 and fluid supply inlet 26 of toothbrush 10*c* are not contained with a rim (such as rim 52 of toothbrush 10*a*).

The toothbrush 10*d* shown in FIG. 16 is very much like toothbrush 10*a*, and is very much like toothbrush 10*b* in that toothbrush 10*d* includes a bend. However, toothbrush 10*d* is different in that, in place of the longitudinal groove 40, a slot 90 is provided through the thickness of the handle to provide venting means. Additionally, the toothbrush 10*d* provides that the gripping portion 92 is generally oval which provides enhanced grip.

FIG. 17 shows a cross-sectional profile of a toothbrush 10*e* which is very much like any of the toothbrushes 10*a*–10*d* already described, except that toothbrush 10*e* includes rubber grip portions 98.

The toothbrush 10*f* shown in FIG. 18 is very much like the toothbrush 10*a* shown in FIGS. 1 and 2 (and FIGS. 3–10), and includes bristles 32 and a rim 100. However, unlike toothbrush 10*a*, toothbrush 10*f* provides that the bristles 32 are attached directly to the lower portion 42, as opposed to being attached to a pad.

The toothbrush 10*g* shown in FIG. 19 is very much like the toothbrush 10*a* shown in FIGS. 1 and 2 (and FIGS. 3–10), but instead of including a single longitudinal groove for venting, the toothbrush 10*g* includes three small ribs 102 on the top surface to prevent a build up of vacuum in a user's mouth.

With regard to use, use of toothbrushes 10*b*–10*g* is very much the same as toothbrush 10*a*.

While embodiments of the present invention are shown and described, it is envisioned that those skilled in the art may devise various modifications of the present invention without departing from the spirit and scope of the appended claims.

What is claimed is:

1. A toothbrush comprising a handle with a head portion, a recess in the head portion of the handle, a bristle pack located in the recess with bristles attached by one end to a base of the recess, an opening of the recess being bounded by inwardly directed shoulders of a rim, outer extremities of the bristles lying in abutting relationship with inner faces of the shoulders of the rim, and there being a fluid supply line provided along or through the handle and communicating with the recess in the form of a supply line disposed among the bristles.

2. A toothbrush as in claim 1, wherein air vent means are provided located on the handle and extending along the handle from a position in close proximity to the bristles to a position where it cannot be fouled by the mouth of the user.

3. A toothbrush as in claim 2, wherein the air vent means is formed by at least one longitudinal groove on the handle, one end of which is in close proximity to the bristles and the other end of which is sufficiently distanced therefrom to ensure that it cannot be fouled by the mouth.

4. A toothbrush as in claim 2, wherein the air vent means comprises a slot through a thickness of the handle.

5. A toothbrush as in claim 2, wherein the air vent means comprises a plurality of ribs on a surface of the toothbrush.

6. A toothbrush as in claim 1, wherein the handle includes a bend.

7. A toothbrush as in claim 1, wherein the toothbrush includes structure configured to receive a placard.

8. A toothbrush as in claim 7, wherein the structure configured to receive a placard comprises flanges which define a channel.

9. A toothbrush as in claim 1, wherein the supply line is disposed centrally among the bristles.

10. A toothbrush comprising a handle with a head portion, bristles attached to the head portion, a fluid supply line provided along or through the handle and communicating with the head portion in the form of a supply line disposed among the bristles, a vacuum supply line provided along or through the handle and communicating with the head portion, air vent means on the handle and extending along the handle from a position in close proximity to the bristles to a position where it cannot be fouled by the mouth of the user.

11. A toothbrush as in claim 10, wherein the air vent means is formed by at least one longitudinal groove on the handle, one end of which is in close proximity to the bristles and the other end of which is sufficiently distanced therefrom to ensure that it cannot be fouled by the mouth.

12. A toothbrush as in claim 10, wherein the air vent means comprises a slot through a thickness of the handle.

13. A toothbrush as in claim 10, wherein the supply line is disposed centrally among the bristles.

14. A toothbrush comprising a handle with a head portion, a recess in the head portion of the handle, a pad located in the head portion, a bristle pack located in the recess with bristles attached by one end to the pad, an opening of the recess being bounded by inwardly directed shoulders of a rim, outer extremities of the bristles lying in abutting relationship with inner faces of the shoulders of the rim, and there being a fluid supply line provided along or through the handle and communicating with the recess in the form of a supply line disposed among the bristles.

15. A toothbrush as in claim 14, wherein air vent means are provided located on the handle and extending along the handle from a position in close proximity to the bristles to a position where it cannot be fouled by the mouth of the user.

16. A toothbrush as in claim 15, wherein the air vent means is formed by at least one longitudinal groove on the handle, one end of which is in close proximity to the bristles and the other end of which is sufficiently distanced therefrom to ensure that it cannot be fouled by the mouth.

17. A toothbrush as in claim 15, wherein the air vent means comprises a slot through a thickness of the handle.

18. A toothbrush as in claim 15, wherein the air vent means comprises a plurality of ribs on a surface of the toothbrush.

19. A toothbrush as in claim 14, wherein the handle includes a bend.

20. A toothbrush as in claim 14, wherein the toothbrush includes structure configured to receive a placard.

21. A toothbrush as in claim 20, wherein the structure configured to receive a placard comprises flanges which define a channel.

22. A toothbrush as in claim 14, wherein the supply line is disposed centrally among the bristles.

23. A toothbrush comprising a handle with a head portion, a recess in the head portion of the handle, a bristle pack located in the recess with bristles attached by one end to a base of the recess, an opening of the recess being bounded by inwardly directed shoulders of a rim, outer extremities of the bristles lying in abutting relationship with inner faces of the shoulders of the rim, and there being a fluid supply line provided along or through the handle and communicating with the recess; wherein air vent means are provided located on the handle and extending along the handle from a position in close proximity to the bristles to a position where it cannot be fouled by the mouth of the user; wherein the air vent means is formed by at least one longitudinal groove on the handle, one end of which is in close proximity to the bristles and the other end of which is sufficiently distanced therefrom to ensure that it cannot be fouled by the mouth.

24. A toothbrush comprising a handle with a head portion, a recess in the head portion of the handle, a bristle pack located in the recess with bristles attached by one end to a base of the recess, an opening of the recess being bounded by inwardly directed shoulders of a rim, outer extremities of the bristles lying in abutting relationship with inner faces of the shoulders of the rim, and there being a fluid supply line provided along or through the handle and communicating with the recess; wherein air vent means are provided located on the handle and extending along the handle from a position in close proximity to the bristles to a position where it cannot be fouled by the mouth of the user; wherein the air vent means comprises a slot through a thickness of the handle.

25. A toothbrush comprising a handle with a head portion, a recess in the head portion of the handle, a bristle pack located in the recess with bristles attached by one end to a base of the recess, an opening of the recess being bounded by inwardly directed shoulders of a rim, outer extremities of the bristles lying in abutting relationship with inner faces of the shoulders of the rim, and there being a fluid supply line provided along or through the handle and communicating with the recess; wherein air vent means are provided located on the handle and extending along the handle from a position in close proximity to the bristles to a position where it cannot be fouled by the mouth of the user; wherein the air vent means comprises a plurality of ribs on a surface of the toothbrush.

26. A toothbrush comprising a handle with a head portion, a recess in the head portion of the handle, a pad located in the head portion, a bristle pack located in the recess with bristles attached by one end to the pad, an opening of the recess being bounded by inwardly directed shoulders of a rim, outer extremities of the bristles lying in abutting relationship with inner faces of the shoulders of the rim, and there being a fluid supply line provided along or through the handle and communicating with the recess; wherein air vent means are provided located on the handle and extending along the handle from a position in close proximity to the bristles to a position where it cannot be fouled by the mouth of the user; wherein the air vent means is formed by at least one longitudinal groove on the handle, one end of which is in close proximity to the bristles and the other end of which is sufficiently distanced therefrom to ensure that it cannot be fouled by the mouth.

27. A toothbrush comprising a handle with a head portion, a recess in the head portion of the handle, a pad located in the head portion, a bristle pack located in the recess with bristles attached by one end to the pad, an opening of the recess being bounded by inwardly directed shoulders of a rim, outer extremities of the bristles lying in abutting relationship with inner faces of the shoulders of the rim, and there being a fluid supply line provided along or through the handle and communicating with the recess; wherein air vent means are provided located on the handle and extending along the handle from a position in close proximity to the bristles to a position where it cannot be fouled by the mouth of the user; wherein the air vent means comprises a slot through a thickness of the handle.

28. A toothbrush comprising a handle with a head portion, a recess in the head portion of the handle, a pad located in the head portion, a bristle pack located in the recess with bristles attached by one end to the pad, an opening of the recess being bounded by inwardly directed shoulders of a rim, outer extremities of the bristles lying in abutting relationship with inner faces of the shoulders of the rim, and there being a fluid supply line provided along or through the handle and communicating with the recess; wherein air vent means are provided located on the handle and extending along the handle from a position in close proximity to the bristles to a position where it cannot be fouled by the mouth of the user; wherein the air vent means comprises a plurality of ribs on a surface of the toothbrush.

* * * * *